US005446615A

United States Patent [19]

Matsumoto et al.

[11] Patent Number: 5,446,615

[45] Date of Patent: Aug. 29, 1995

[54] ELECTRIFYING METHOD AND ELECTRIFYING APPARATUS USED THEREFOR

[75] Inventors: Shoji Matsumoto; Masanori Matsuda; Eiji Goto; Akinori Nishida; Teruaki Higashiguchi; Isao Iwagawa, all of Osaka, Japan

[73] Assignee: Mita Industrial Co., Ltd., Osaska, Japan

[21] Appl. No.: 37,419

[22] Filed: Mar. 26, 1993

[30] Foreign Application Priority Data

Mar. 26, 1992 [JP] Japan ..... 4-068148

[51] Int. Cl.[6] ..... G03G 15/02

[52] U.S. Cl. ..... 361/225; 355/219

[58] Field of Search ..... 361/214, 220, 221, 225, 361/229, 230, 231; 355/219

[56] References Cited

U.S. PATENT DOCUMENTS

| | | | |
|---|---|---|---|
| 3,936,174 | 2/1976 | Carpenter | 355/219 |
| 4,309,803 | 1/1982 | Blaszak | 355/219 X |
| 4,380,384 | 4/1983 | Ueno et al. | 355/219 |
| 4,810,432 | 3/1989 | Kisler | 361/225 X |
| 4,851,960 | 7/1989 | Nakamura et al. | |
| 4,922,299 | 5/1990 | Uchimoto | 355/219 |
| 4,999,733 | 3/1991 | Kakuda | 361/221 X |
| 5,126,913 | 6/1992 | Araya et al. | 361/225 |
| 5,177,534 | 6/1993 | Kisu et al. | 355/219 |
| 5,196,892 | 3/1993 | Mitsuaki | 355/219 |
| 5,243,387 | 9/1993 | Ikegawa | 355/219 |

FOREIGN PATENT DOCUMENTS

| | | | |
|---|---|---|---|
| 0308185 | 9/1988 | European Pat. Off. | |
| 3101678 | 12/1981 | Germany | |
| 57-46265 | 3/1982 | Japan | 355/219 |
| 60-220588 | 5/1985 | Japan | |
| 1-191161 | 1/1989 | Japan | |
| 3-203754 | 5/1991 | Japan | |
| 5-273844 | 10/1993 | Japan | 355/219 |

OTHER PUBLICATIONS

Patent Abstracts of Japan vol. 13, No. 1 (P-808)(3349) 6 Jan. 1989 & JP-A-63 210 862 (Shindengen Electric MGF Co. Ltd.) 1 Sep. 1988.

*Primary Examiner*—Brian K. Young
*Assistant Examiner*—Fritz M. Fleming
*Attorney, Agent, or Firm*—Sherman and Shalloway

[57] ABSTRACT

An electrifying method which uses a electrifying a material wherein the contact-type electrifying member comprises a flexible and electrically conducting endless sheet and a brush which supports said endless sheet and imparts a pressing force thereto at a position where said endless sheet is in contact with the material to be electrified, said endless sheet which is impressed with an electrification voltage is driven or is moved at a speed which is substantially in synchronism with the material to be electrified, and the brush and the endless sheet are maintained at dissimilar speeds. This method makes it possible that homogeneously and uniformly electrifying a material to be electrified such as a photosensitive material or a like material without causing it to be damaged or worn out, even when the material electrifying member is rugged or even when a foreign matter is adhered on the surface of the photosensitive material, and a toner filming is not formed on the surface of the photosensitive material, and maintaining a uniformly contacting state between the electrifying member and the photosensitive material even with a relatively small force, as a result, accomplishes homogeneous electrification while preventing the photosensitive material from being worn out.

14 Claims, 4 Drawing Sheets

ELECTRIFYING METHOD AND ELECTRIFYING APPARATUS USED THEREFOR

BACKGROUND OF THE INVENTION

1. Field of the Invention

The present invention relates to a novel electrifying method and to an electrifying apparatus used therefor. More specifically, the invention relates to a method of uniformly electrifying a material to be electrified such as a photosensitive material or like materials without causing the surface thereof to be damaged or worn out and to an apparatus used for the above method.

2. Description of the Prior Art

An electrophotographic apparatus is employing a system which forms an electrostatic latent image by uniformly electrifying the surface of a photosensitive material, and exposing the thus electrified photosensitive material to the light bearing image.

A corona wire has heretofore been widely used for electrifying a material that is to be electrified such as a photosensitive material and the like materials. The corona electrification, however, requires a high-voltage generating device for generating a corona discharge which causes the electrifying apparatus to become expensive. Moreover, the corona discharge involves the generation of ozone and harmful components such as $NO_x$ and the like, which are hazardous to the environment and deteriorate the photosensitive material.

In order to solve the above problems, there have been proposed a variety of so-called contact electrification systems which perform the electrification by bringing an electrification mechanism and a photosensitive material into direct contact with each other. These systems can be roughly divided into a brush electrification system, a roller electrification system, and a blade electrification system.

A brush electrification system has been disclosed in Japanese Patent Publication No. 220588/1985 according to which the electrification is effected by bringing an electrically conducting brush having electrically conducting contactors into contact with a photosensitive material, the contactors having a resistivity of $100^0$ to $10^4$ ohms.cm, a thickness of 3 denier (d) to 6 d, and being provided at a density of 50,000 to 200,000 hairs/-square inch.

As for a roller electrification system, Japanese Unexamined Patent Laid-Open No. 149668/1988 discloses a contact electrification method which performs the electrification by applying a voltage to an electrically conducting member that is in contact with the surface of a material to be electrified, wherein said electrically conducting member has a surface region that comes in contact with the surface of the material to be electrified and a surface region which is continuous thereto and gradually separates away from the surface of the material to be electrified, as it goes toward the downstream side in the direction in which the surface of the material to be electrified moves, and wherein a pulsating voltage having an inter-peak voltage which is more than twice as great as the electrification start voltage is applied to said electrically conducting member, thereby to establish an oscillation electric field between said separating region of said member and the surface of the material to be electrified and, thus, to electrify the material. Moreover, Japanese Unexamined Patent Laid-Open No. 19116/1989 discloses a roller that is formed between the electrically conducting lower layer and the upper layer having a high resistance.

As for a blade electrification system, Japanese Unexamined Patent Laid-Open No. 203754/1991 discloses an electrifying device having an electrifying blade with its tip being opposed to the direction in which the material to be electrified moves and is in contact with the material to be electrified, the electrifying blade being so disposed as to form a wedge-like gap relative to the material to be electrified, and the electrifying blade further having a resistor that serves as an electric discharge electrode which will be impressed with a voltage at a portion opposed to the material that is to be electrified.

The above-mentioned contact electrification systems have a merit in that they require application voltages lower than that of the corona electrification system, and generate neither ozone nor $NO_x$, but have a defect in that the electrification is not so uniform as that accomplished by the corona electrification system.

That is, in the case of the brush electrification, the contact between the electrifying member (brush) and the material to be electrified is a point contact or a line contact; i.e., when viewed microscopically, there develop portions which are not electrified causing the electrification to become nonuniform. Moreover the brush that comes into direct contact with the surface of the photosensitive material causes the photosensitive material to be worn out. The tendency of wear appears conspicuously when the brush is rotated at a high speed in an attempt to accomplish uniform electrification. Furthermore, the brush has a short life since it is subject to be worn out, or loses hair and performance.

In the case of the electrification system using an electrically conducting roller, any ruggedness in the photosensitive material makes it difficult to bring the recessed portions into uniform contact with the roller despite a line pressure is given to the roller, making it still difficult to accomplish uniform electrification. Generally, dust, paper powder and toner are adhered to,the surface of the photosensitive material. Presence of foreign matter between the roller and the photosensitive material. The presence of foreign matter between the roller and the photosensitive material causes the electrification to become defective in the direction of width. If a large pressure is given to the roller in an attempt to solve the above problems, however, the result is that the photosensitive material is subject to be worn out conspicuously. It may be contrived to impart soft cushioning property to the surface of the roller. However, the electrically conducting rubber has a limit in its softness and, besides, a softening agent (plasticizer) in the rubber migrates onto the surface to contaminate the photosensitive layer.

Even in the-case of the blade electrification system like in the case of the roller electrification system, the electrification is not only not uniformly accomplished but this tendency rather becomes more conspicuous due to blade inversion (turn up) and cracking from the friction by the surface of the photosensitive material. Accordingly, the photosensitive material is more worn out and damaged.

SUMMARY OF THE INVENTION

The object of the present invention therefore is to provide an electrifying method which is capable of homogeneously and uniformly electrifying a material to be electrified such as a photosensitive material or a like material without causing it to be damaged or worn out, and an apparatus therefor.

Another object of the present invention is to provide an electrifying method which is capable of accomplishing homogeneous and uniform electrification even when the material to be electrified such as a photosensitive material or a like material is rugged or even when a foreign matter is adhered on the surface of the photosensitive material, and an apparatus therefor.

A further object of the present invention is to provide an electrifying method which is capable of maintaining a uniformly contacting state between the electrifying member and the photosensitive material even with a relatively small force and which, as a result, accomplishes homogeneous electrification while preventing the photosensitive material from being worn out, and an apparatus therefor.

According to the present invention, there is provided an electrifying method for electrifying a material that is to be electrified by bringing an electrifying member impressed with a voltage into physical contact with the material to be electrified, wherein the electrifying member comprises a flexible and electrically conducting endless sheet and a brush which supports said endless sheet and imparts a pressing force thereto at a position where said endless sheet is in contact with the material to be electrified, said endless sheet which is impressed with an electrification voltage is driven or is moved at a speed which is substantially in synchronism with the material to be electrified, and the brush and the endless sheet are maintained at dissimilar speeds.

According to the present invention, furthermore, there is provided an electrifying apparatus for electrifying a material to be electrified by bringing an electrifying member impressed with a voltage into physical contact with the material to be electrified, wherein said electrifying member comprises a flexible, hollow and electrically conducting roller, a brush roller which is provided inside said hollow and electrically conducting roller in concentric therewith and to rotate mutually thereto, a feeding mechanism which applies an electrification voltage to said hollow and electrically conducting roller, a drive mechanism which drives the hollow and electrically conducting roller at a speed in synchronism with the material to be electrified, and a drive mechanism which drives the brush roller at a speed different from that of the hollow and electrically conducting roller.

According to the present invention, there is further provided an electrifying apparatus for electrifying a material to be electrified by bringing an electrifying member impressed with a voltage into physical contact with the material to be electrified, wherein said electrifying member comprises a flexible and electrically conducting endless belt, a rotary brush roller which is opposed to the material to be electrified via an endless belt and depresses the endless belt onto the material to be electrified, a feeding mechanism which applies an electrification voltage to the endless belt, a drive mechanism which drives the endless belt at a speed in synchronism with the material to be electrified, and a drive mechanism which drives the brush roller at a speed different from that of the endless belt.

According to the present invention, the electrifying member which is impressed with a voltage and comes in contact with a material to be electrified comprises the combination of a flexible and electrically conducting endless sheet and a brush which supports the endless sheet and imparts a pressing force thereto at a position where the endless sheet comes in contact with the material to be electrified.

In this combination, what comes in contact with the material to be electrified is the flexible electrically conducting sheet, what urges the electrically conducting sheet to come in contact with the material to be electrified is the brush, and what makes a feature of the present invention is that the electrifying member has separate functions as described above.

First, the electrically conducting sheet is flexible and is deformable enabling itself to be brought into uniform contact with the whole surface of the material to be electrified despite the presence of roughness. Even in case foreign matters such as dust, paper powder, residual toner and the like are adhered onto the surface of the material to be electrified, the electrically conducting sheet comes into uniform contact with the surface other than those portions where the foreign matters are adhered. Furthermore, the individual ends of the brush work as pushing springs, i.e., work as finest and dense urging springs, enabling uniform and smooth contact to be realized between the electrically conducting sheet and the material to be electrified. That is, with the electrification using a brush, the contact relative to the material to be electrified becomes a point contact or a line contact as pointed out already. According to the present invention in which the flexible and electrically conducting sheet is interposed between the brush and the material to be electrified, however, a uniform surface contact is realized with respect to the material to be electrified requiring a small pressure produced by the brush and uniform electrification is accomplished.

According to the present invention, it is also important to drive or move the electrically conducting sheet at a speed which is substantially in synchronism with that of the material to be electrified, and to maintain the brush and the endless sheet at speeds which are different from each other.

If there is a difference in the speed between the material to be electrified and the flexible and electrically conducting sheet, the sheet is twisted and convoluted giving disadvantage from the standpoint of smoothly operating the electrifying apparatus and its life. Moreover, the electrically conducting sheet that is twisted and convoluted makes it difficult to accomplish uniform electrification. According to the present invention, the flexible and electrically conducting sheet is driven or is moved at a speed which is substantially in synchronism with that of the material to be electrified in order to eliminate friction between them and to prevent the surface of the material to be electrified from being worn out or damaged.

With the flexible and electrically conducting sheet and the brush being maintained at dissimilar speeds, furthermore, the brush traces on the flexible and electrically conducting sheet under the condition where the flexible and electrically conducting sheet is in contact with the material to be electrified. Therefore, very uniform and intimate contact is accomplished between the flexible and electrically conducting sheet and the surface of the material to be electrified.

DESCRIPTION OF THE PREFERRED EMBODIMENTS

(Electrifying Apparatus)

Figure 1:
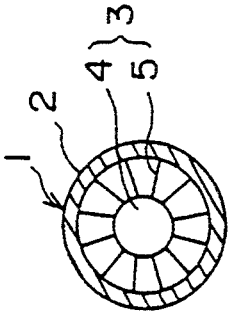
FIG. 1(*a*) is a sectional view and FIG. 1(*b*) is a side view illustrating an electrifying apparatus according to the present invention.
Figure 1:
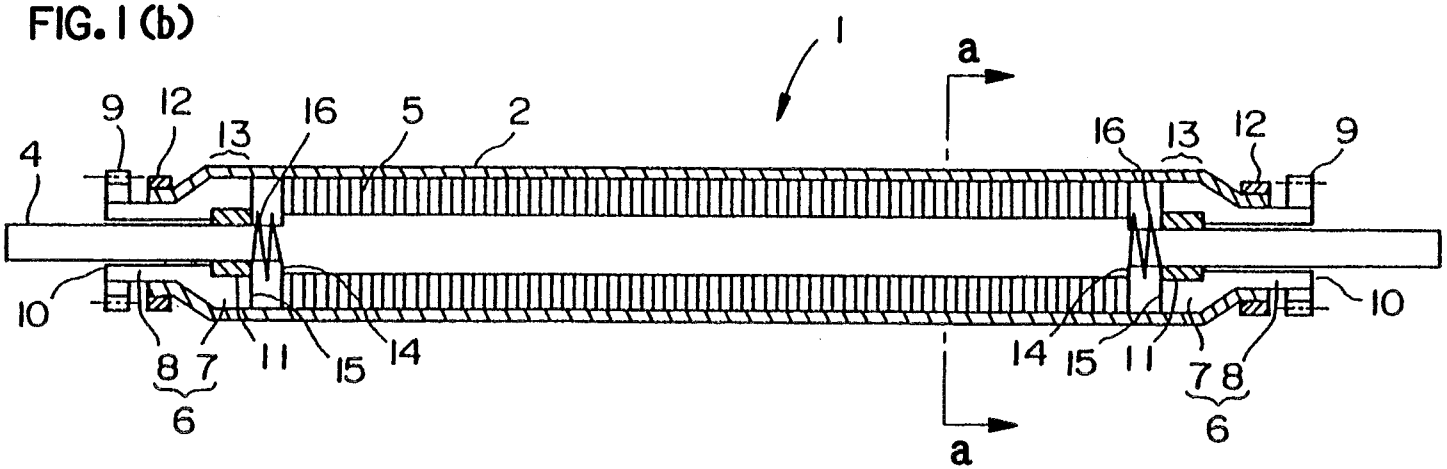

In the electrifying apparatus used in the present invention, the flexible and electrically conducting endless sheet may be a seamless tube such as a flexible, hollow and electrically conducting roll or a flexible and electrically conducting endless belt.

The brush works as a rotary brush roller. Here, the end of the brush may comprise an electrically conducting organic fiber or a metal fiber, or may comprise an electrically nonconducting organic or inorganic fiber. In the former case, the electricity is fed to the electrically conducting sheet via the brush and in the latter case, the electricity is fed by a feeding mechanism which is separate from the brush.

An example of the electrifying apparatus of the present invention will now be described with reference to FIG. 1-*a* (sectional view) and FIG. 1-*b* (side view). Roughly speaking, the electrifying apparatus 1 is constituted by a flexible and hollow electrically conducting roller 2 and a brush roller 3 which is provided inside the flexible roller 2 in concentric therewith and to rotate relative thereto.

The brush roller 3 comprises a drive shaft 4 and a brush 5 studded on the shaft. In this embodiment, the brush 5 is made of an electrically conducting fiber. The hollow electrically conducting roller 2 has a rigid end 6 at both ends thereof, each end 6 having a large-diameter portion 7 and a small-diameter portion 8 that is drawn in a tapered manner from the large-diameter portion. A drive gear 9 is fastened to the small-diameter portion 8. A hole 10 is formed penetrating through the center of the end 6, and the drive shaft 4 of the brush roller penetrates through the hole 10 to extend outwardly of the end 6. A bearing 11 is provided between the end 6 and the brush drive shaft 4 so that they are allowed to rotate relative to each other. The flexible hollow roller 2 is supported by the outer periphery of the large-diameter portion 7 of the end 6, and its tip is fastened to the small-diameter portion 8 of the end 6 by using a fastening member 12. In this embodiment, the fastening member 12 is a heat-shrinkable resin ring (tube), and both tips of the flexible hollow roller 2 are fastened to the ends 6 by the heat-shrinkage. The inner surface of the flexible hollow roller 2 is in contact with the brush 5 that is accommodated therein and is supported by the brush 5. The large-diameter portion 7 of the end 6 serves as a contact portion 13 for the material to be electrified (not shown) via its surrounding flexible roller. The flexible hollow roller 2 is supported by the brush 5 between the contact portions 13 and 13, and has a diameter which is slightly greater than the outer diameter of the contact portions 13 and 13. In order to place the flexible hollow roller 2 in position, furthermore, a spring 16 is provided between the tip 14 of the brush 5 and the inner tip 15 of the end 6 to impart some tension to the flexible and electrically conducting hollow roller 2 in the axial direction.

Figure 2:
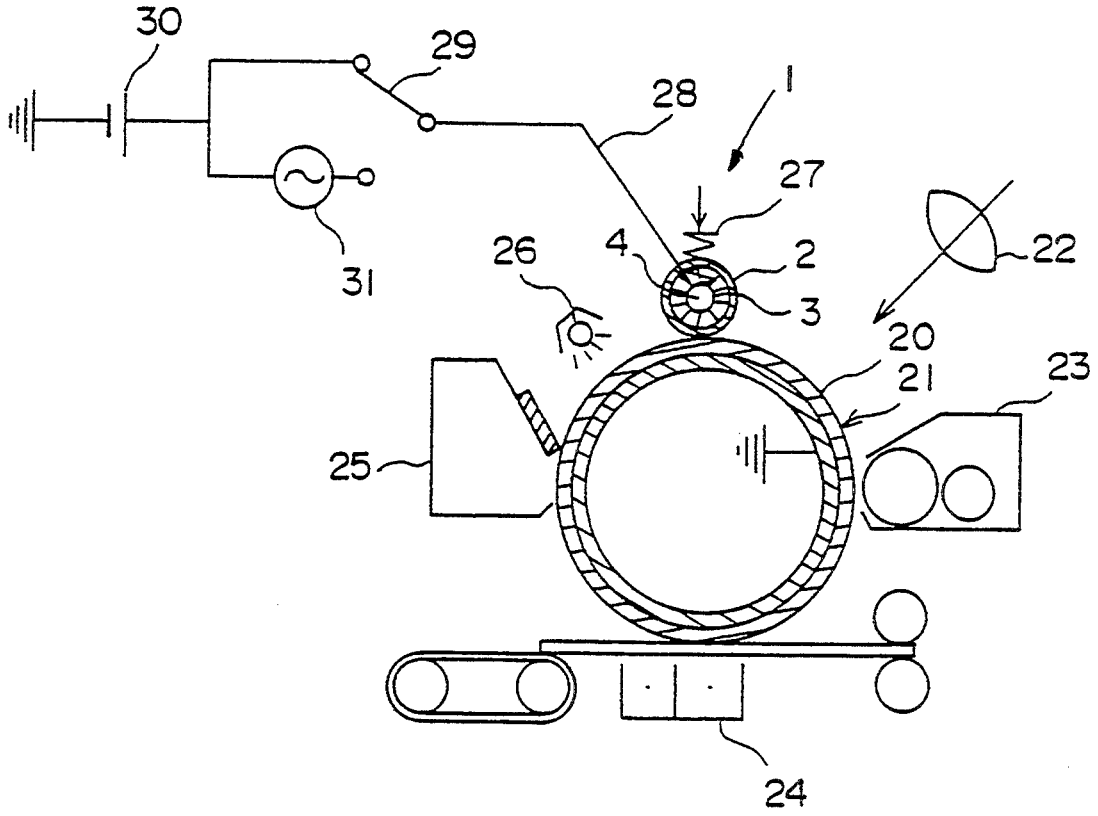
FIG. 2 is a schematic diagram of when the electrifying apparatus is adapted to a copying machine.

Referring to FIG. 2 in which the electrifying apparatus of FIG. 1 is applied Go an electrophotographic copying machine, a rotary drum 21 equipped with an electrophotosensitive layer (material to be electrified) 20 is surrounded by the electrifying apparatus 1, an image exposure mechanism 22, a developing mechanism 23, a toner transfer mechanism 24, a cleaning mechanism 25, and an exposure de-electrifying mechanism 26. The electrifying apparatus 1 as a whole is brought into contact with the photosensitive drum 21 under the application of a predetermined pressure produced by such means as a pushing spring 27. The flexible, hollow and electrically conducting roller 2 is driven at a speed in synchronism with the photosensitive drum 21, and the brush roller 3 is driven via the drive shaft 4 at a speed different from that of the hollow and electrically conducting roller 2. The drive shaft 4 is electrically insulated from the frame or from the drive system, and is connected to a DC power source 30 and a pulsating electrifying power source 31 via a collector (not shown), a wiring 28, and a change-over switch 29.

By using the electrifying apparatus 1 of the present invention, the photosensitive layer 20 is uniformly electrified without being worn out. Through exposure to image, therefore, an electrostatic latent image is formed maintaining a high contrast without disturbance. Then, through the subsequent developing and transfer operations, there is obtained a copy maintaining a high concentration and excellent picture quality.

Figure 3:
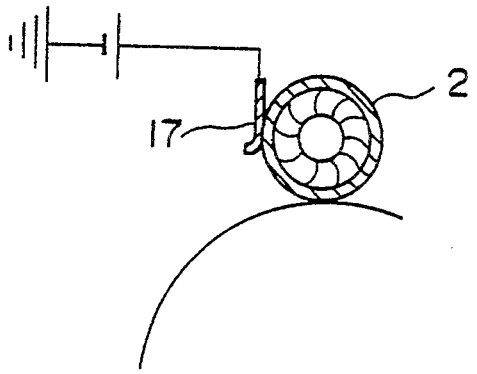
FIG. 3 is a schematic diagram of when a collector is used as a voltage application means for the electrifying apparatus.

When the brush roller is the one having electrically insulating property, the flexible, hollow and electrically conducting roller 2 should be provided with a collector 17 that comes in pressed contact therewith as shown in FIG. 3, and a voltage for electrification should be fed to the roller 2 via the collector 17.

Figure 4:
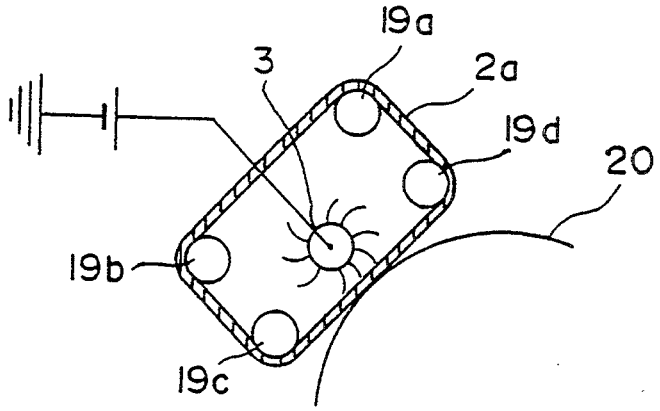
FIG. 4 is a schematic diagram of the electrifying apparatus employing a belt.

As shown in FIG. 4, furthermore, it is allowed to use a flexible and electrically conducting endless belt 2*a* instead of the flexible, hollow and electrically conducting roller 2. In this case, the flexible and electrically conducting endless belt 2*a* should be fed between the brush roller 3 and the material 20 to be electrified via insulating guide rollers 19*a*, 19*b*, 19*c* and 19*d* at a speed in synchronism with the material 20 to be electrified.

In the present invention, the flexible and electrically conducting sheet may be made of any material provided it has electrically conducting property and flexibility. For instance, the sheet may be made of an electrically conducting resin or rubber, a metal such as a foil, or a laminated material of a metal and a resin or a rubber.

Examples of the electrically conducting resin or rubber will be those resins or rubbers blended with a variety of electrically conducting agents. As a resin, there can be preferably used a variety of thermoplastic elastomers such as a polyester-type elastomer, a polyamide-type elastomer, a polyurethane-type elastomer, a soft vinyl chloride resin, a styrene-butadiene-styrene block copolymeric elastomer, an acryl-type elastomer, and the like. As the resin, there can be further used a nylon 6, a nylon 6,6, a nylon 6-nylon 6,6 copolymer, a nylon 6,6-nylon 6,10 copolymer, or a polyamide or a copolyamide like an alkoxymethylated nylon 6,10 copolymer, or a polyamide or a copolyamide like an alkoxymethylated nylon 6,10 copolymer, or a polyamide or a copolyamide like an alkoxymethylated nylon such as a methoxymethylated nylon or the like, or modified products thereof. Examples of the resin that can be used are not necessarily limited to those mentioned above but may be a silicone resin, an acetal resin such as a polyvinyl butyral, a polyvinyl acetate, an ethylene-vinyl acetate copolymer, an ionomer and the like. Examples of the rubber include a natural rubber, a butadiene stereo rubber, a styrene-butadiene rubber, a nitril-butadiene rubber, an ethylene-propylene copolymer rubber, an ethylene-propylene-nonconjugated diene copolymer rubber, a chloroprene rubber, a butyl rubber, a silicone rubber, an urethane rubber, an acrylic rubber, and the like.

Examples of the electrically conducting agent include powdery electrically conducting agents such as an electrically conducting carbon black, metal powders such as of silver, gold, copper, brass, nickel, aluminum and stainless steel, and a tin oxide-type electrically conducting agent, as well as nonionic, anionic, cationic and amphoteric organic electric conducting agents and organotin-type electrically conducting agent.

The electrically conducting resin or rubber should have an electric resistance (resistivity) over a range of, generally, from 10 to $10^8$ ohms.cm and, particularly, from $10^2$ to $10^6$ ohms.cm. The electrically conducting agent is blended in an amount of from 1 to 20 parts by weight and, particularly, from 5 to 15 parts by weight per 100 parts by weight of the resin or the rubber to obtain the above-mentioned resistance, though the blending amount may vary depending upon the kind of the electrically conducting agent. A higher conduction is obtained when a chain structure is formed by the conduction agent particles in the electrically conducting resin or the rubber. In this case, however, the electrification tends to take place nonuniformly, i.e., there tends to develop high potential dots. Therefore, the conduction particles should be uniformly and finely dispersed in the resin or in the rubber. For this purpose, it is important to sufficiently knead the resin or the rubber blended with the electric conduction agent. For instance, it is effective to use a resin or a rubber modified with an acid, i.e., to use a resin or a rubber copolymerized with an ethylenically unsaturated carboxylic acid such as acrylic acid, methacrylic acid, or maleic anhydride, at least as part of the resin or the rubber.

The sheet made of the electrically conducting resin or rubber used in the present invention should have a thickness of generally from 50 to 400 μm and, particularly, from 100 to 300 μm though it may vary depending upon its softness. Furthermore, the surface should be smooth as much as possible, and the average coarseness should be smaller than 5 μm and, particularly, smaller than 1 μm as measured in compliance with JIS B 0601.

The seamless tube or the seamless belt can be molded by the extrusion molding using a ring die, or by the fluidized immersion method of the resin or the rubber powder into a mandrel or a cylindrical mold coated with a parting agent, or by the immersion coating film-making method using a latex, an emulsion, a suspension or a solution.

According to the present,invention, there can be used a seamless metal foil as a flexible and electrically conducting sheet. The metal foil may be that of nickel, aluminum, copper, brass, tin or the like, and is obtained by the electroforming method or by the extrusion. The metal foil should have a thickness of from 20 to 80 μm and, particularly, from 30 to 50 μm.

The flexible and electrically conducting sheet may be made of a material of a single layer or of a laminated layer, or may be made of materials of a plurality of layers. When the surface of the flexible and electrically conducting sheet that comes in contact with the material to be electrified is formed of a layer having a large resistance, the leakage such as electric discharge or the like can be effectively prevented even in case electrically conducting scars or protuberances exist on the surface of the photosensitive layer. The high-resistance layer should have a resistivity of from $10^8$ to $10^{13}$ ohms.cm and, particularly, from $10^9$ to $10^{12}$ ohms.cm, and should have a thickness over a range of from 40 to 60 μm. The electric resistance can be easily adjusted by adjusting the amount of the electrically conducting agent blended in the resin or the rubber. The electrically conducting agent and the resin or the rubber may be those mentioned already. Here, however, the resin or the rubber will be a fluorine-containing resin or rubber such as a polyvinylidene fluoride (PVDF), a polytetrafluoroethylene (PTFE), a tetrafluoroethylene-hexafluoropropylene copolymer (PTFE.HFP), a perfluoroalkoxy, or the like. The above resin or rubber used as a high-resistance layer gives a great merit from the standpoint of life of the photosensitive material and the life of the flexible and electrically conducting sheet. When the metal foil is to be used, it is recommended to use the high-resistance layer that is coated or laminated. The high-resistance layer is formed by the coating or by the simultaneous extrusion of the laminated layer.

The brush may be either the electrically conducting brush or the insulating brush. The electrically conducting brush is made of an electrically conducting organic or inorganic fiber and should have a volume resistivity of from $10^2$ *to* $10^8$ ohms.cm and, particularly, from $10^3$ to $10^6$ ohms.cm. The fiber should have a thickness of from 2 to 10 denier (d) and, particularly, from 3 to 6 d, thee fiber length (hair length) should be from 2 to 7 mm and, particularly, from 3 to 5 mm, and the hair density should be from 10,000 to 200,000 hairs/sq. in. and, particularly, from 30,000 to 100,000 hairs/sq. in. from the standpoint of imparting smooth and-uniform pressing force. Moreover, the tips of the brush should be rounded from the standpoint of suppressing the flexible and electrically conducting sheet from being worn out.

The organic electrically conducting fiber will be a synthetic or a regenerated fiber in which the electrically conducting agent is dispersed, such as a polyamide fiber, e.g., nylon 6 or nylon 6,6, a polyester fiber, e.g., a polyethylene terephthalate, or an acrylic fiber, a polyvinyl alcohol fiber, a polyvinyl chloride fiber, rayon, acetate, or the like. The electrically conducting property can be imparted to the fiber not only by the method of blendings the electrically conducting agent but also by the method of metallizing the surfaces of the fibers. The electrically conducting agent may be the one mentioned above.

A preferred example of the electrically conducting inorganic fiber is a carbon fiber. There, however, can be used a metal fiber such as of a stainless steel, a brass or the like.

The electrically insulating brush will be made of the aforementioned organic fiber that does not contain the electrically conducting agent. The denier, fiber length and hair density may lie within the aforementioned ranges.

Electrifying Method

According to the electrifying method of the present invention, the flexible and electrically conducting endless sheet is driven or is moved at a speed in synchronism with the speed at which the material to be electrified is moving, and the brush is driven at a speed different from that of the electrically conducting endless sheet. The brush is driven in a direction which is either the same as or opposite to the direction in which the electrically conducting endless sheet is driven. When driven in the same direction, the speed of the brush should generally be from 1.1 to 5 times and, particularly, from 1.5 to 3 times as great as the moving speed of the endless sheet. When driven in the opposite direction, the speed of the brush should be from 1.1 to 3 times and, particularly, from 1.5 to 2 times as great as the moving speed of the endless sheet, from the standpoint of bringing the flexible and electrically conducting sheet into uniform and intimate contact with the surface of the material to be electrified.

According to the present invention, the electrification voltage applied to the electrically conducting endless sheet should be set to be from 1.5 to 3.5 times and, particularly, from 2 to 3 times as great as the electrification start voltage for the material to be electrified.

Figure 5:
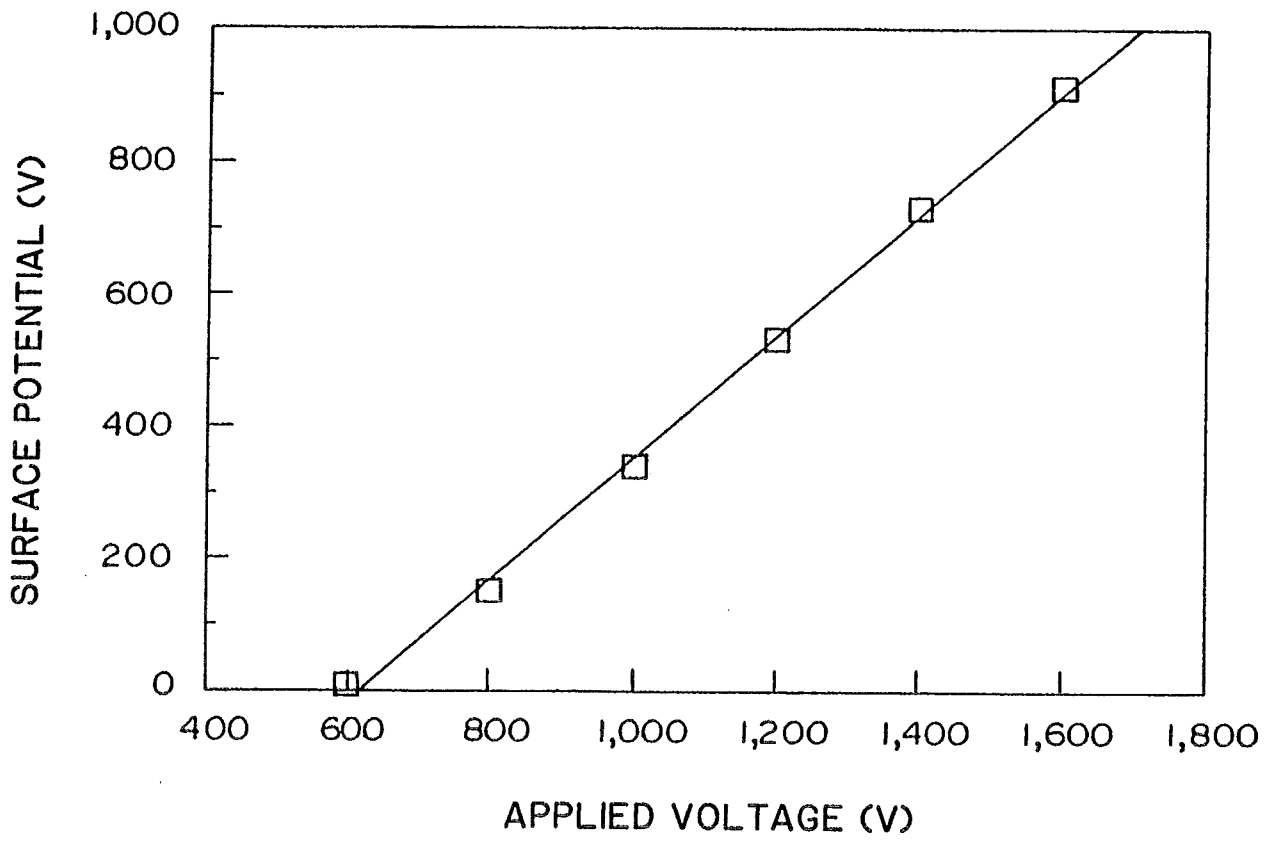
FIG. 5 is a graph showing a relationship between the applied voltage and the potential on the surface of a material to be electrified by using the electrifying apparatus of the present invention.

FIG. 5 illustrates a relationship between the voltage applied to the electrically conducting endless sheet and the surface potential of the material to be electrified when the electrifying method of the present invention is applied to the material to be electrified which is comprised of an organic photosensitive material (for details, reference should be made to embodiments described later). It will be understood from FIG. 5 that a favorable linear relationship is maintained between the applied voltage and the surface potential over an effectively electrified region. From this fact, it can be recognized that the electrifying system of the present invention makes it possible to maintain the surface potential of the photosensitive material at an optimum value at all times by arranging surface potential sensors around the photosensitive material and by increasing or decreasing the applied voltage based on the surface potentials detected by the sensors.

It is a distinguished advantage of the present invention to obtain a uniform and homogeneous electrification by simply using a DC voltage. However, a more uniform electrification can be accomplished by applying a voltage which is obtained by superposing an AC voltage on the above DC voltage. Such an alternating current will have a frequency of from 300 to 1500 Hz and, particularly, from 400 to 1000 Hz, an interpeak voltage of from 2.5 to 4 times and, particularly, from 2.8 to 3.5 times as great as the above DC voltage.

The electrifying method of the present invention is effective in electrifying the photosensitive material in a variety of electrophotographic methods such as in a copying machine, facsimile, laser printer and the like. Here, examples of the photosensitive material include a variety of photosensitive materials of a single layer or a laminated layer structure, such as an a-Si photosensitive material, selenium photosensitive material, and single-layer and multi-layer organic photosensitive materials. Among them, the electrifying method of the present invention can be adapted to the organic photosensitive material without almost generating ozone or $NO_x$ and hence, without deteriorating the electric charge-generating pigment, electric charge transporting substance, binder, dielectric and the like which constitute the photosensitive material, enabling the life thereof to be extended. The electrifying method of the present invention is not limited to the electrification in a narrow sense but can also be used for the de-electrification by applying a bias voltage.

The invention will be described more concretely by way of the embodiments. According to the present invention, the contact-type electrifying member is made up of the combination of a flexible and electrically conducting endless sheet and a brush which supports the endless sheet and imparts a pressing force thereto at a position where the sheet comes in contact with a material to be electrified, and the endless sheet is driven or is moved at a speed substantially in synchronism with the material to be electrified, and the brush and the endless sheet are driven at dissimilar speeds. Therefore, the material to be electrified and the endless sheet come in uniform and intimate surface contact with each other without at all causing the material being electrified to be worn out or damaged, making it possible to accomplish uniform and homogeneous electrification.

In particular, uniform and homogeneous electrification is accomplished being affected by neither the ruggedness on the surface of the material to be electrified nor by the adhesion of foreign matter on the surface of the photosensitive material. A toner filming is not formed on the surface of the photosensitive material, either.

Embodiment 1

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.3 mm | |
| Volume resistivity: $1.4 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 5 mm | |
| Hair density: 100,000 hairs/sq. in. | |
| Electrifying conditions | |
| Applied DC voltage: +1500 V | |
| Number of revolutions of the brush roller: | 225 rpm (rotated in the same direction as the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +800 V | |
| Electrification start voltage: +600 V | |

The thus obtained copy exhibited an image concentration of 1.44 and a fog concentration of 0.002 offering a favorable image without black dotted shades.

Embodiment 2

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.3 mm | |
| Volume resistivity: $1.4 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 5 mm | |
| Hair density: 100,000 hairs/sq. in. | |
| Electrifying conditions | |
| Applied DC voltage: +1500 V | |
| Number of revolutions of the brush roller: | 450 rpm (rotated in the same direction as the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +825 V | |
| Electrification start voltage: +600 V | |

The thus obtained copy exhibited an image concentration of 1.45 and a fog concentration of 0.003 offering a favorable image without black dotted shades.

Embodiment 3

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.3 mm | |
| Volume resistivity: $1.4 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 5 mm | |
| Hair density: 100,000 hairs/sq. in. | |
| Electrifying conditions | |
| Applied DC voltage: +1500 V | |
| Number of revolutions of the brush roller: | 225 rpm (rotated in the direction opposite to the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +850 V | |
| Electrification start voltage: +600 V | |

The thus obtained copy exhibited an image concentration of 1.46 and a fog concentration of 0.002 offering a favorable image without black dotted shades.

Embodiment 4

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.3 mm | |
| Volume resistivity: $1.4 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 5 mm | |
| Hair density: 100,000 hairs/sq. in. | |
| Electrifying conditions | |
| Applied DC voltage: +1500 V | |
| Number of revolutions of the brush roller: | 300 rpm (rotated in the direction opposite to the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +850 V | |
| Electrification start voltage: +600 V | |

The thus obtained copy exhibited an image concentration of 1.46 and a fog concentration of 0.003 offering a favorable image without black dotted shades.

Embodiment 5

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyvinyl chloride-type elastomer | |
| Inner diameter: 20 mm | |
| Thickness: 0.2 mm | |
| Volume resistivity: $1.0 \times 10^3$ ohms · cm | |

-continued

| | |
|---|---|
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 3 mm | |
| Hair density: 100,000 hairs/sq. in. | |
| Electrifying conditions | |
| Applied DC voltage: +1500 V | |
| Number of revolutions of the brush roller: | 225 rpm (rotated in the same direction as the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +800 V | |
| Electrification start voltage: +600 V | |

The thus obtained copy exhibited an image concentration of 1.42 and a fog concentration of 0.003 offering a favorable image without black dotted shades.

Embodiment 6

The electrifying apparatus of FIG. 1 was mounted on a modified electrophotocopying machine DC-2556 manufactured by Mita Industrial Co., Ltd. that employed an organic photosensitive material for negative electrification. The electrification, exposure to light, developing, transfer and fixing were carried out without applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.1 mm | |
| Volume resistivity: $8.0 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 3 mm | |
| Hair density: 100,000 hairs/sq. in. | |
| Electrifying conditions | |
| Applied DC voltage: −1700 V | |
| Number of revolutions of the brush roller: | 225 rpm (rotated in the same direction as the electrically conducting roller) |
| Number of revolutions of the electrically conducting roller: | 150 rpm (rotated following the photosensitive material) |
| Peripheral speed of the photosensitive materials: | 157 mm/sec |
| Surface potential: −880 V | |
| Electrification start voltage: −800 V | |

The thus obtained copy exhibited an image concentration of 1.45 and a fog concentration of 0.002 offering a favorable image without black dotted shades.

Embodiment 7

The electrifying apparatus of FIG. 1 was mounted on a modified electrophotocopying machine DC-2556 manufactured by Mita Industrial Co., Ltd. that employed an organic photosensitive material for positive electrification. The electrification, exposure to light, developing, transfer and fixing were carried out applying an AC voltage.

Properties of the members of the electrifying apparatus and the electrifying conditions were as follows:

| | |
|---|---|
| Electrically conducting roller | |
| Material: polyurethane-type elastomer | |
| Inner diameter: 20 mm | |
| Thickness: 0.3 mm | |
| Volume resistivity: $1.4 \times 10^5$ ohms · cm | |
| Brush roller | |
| Material: electrically conducting rayon | |
| Outer diameter: 19.8 mm | |
| Volume resistivity: $1.0 \times 10^3$ ohms · cm | |
| Thickness of fiber: 6 denier | |
| Length of fiber: 5 mm | |
| Hair density: 100,000 hairs/sq. in. | |
| Electrifying conditions | |
| Applied DC voltage: +1100 V | |
| Applied AC voltage: 1800 $V_{P-P}$ (sinusoidal waveform) | |
| AC frequency: 500 Hz | |
| Number of revolutions of the brush roller: | 225 rpm (rotated in the same direction as the electrically conducting roller) |
| Number of revolutions of the electrically conducting roller: | 150 rpm (rotated following the photosensitive material) |
| Peripheral speed of the photosensitive materials: | 157 mm/sec |
| Surface potential: +800 V | |
| Electrification start voltage: +600 V | |

The thus obtained copy exhibited an image concentration of 1.40 and a fog concentration of 0.002 offering a favorable image without black dotted shades.

We claim:

1. An apparatus for electrifying a material to be electrified by physically contacting an electrifying member with the material to be electrified, wherein the electrifying member comprises a flexible and electrically conducting endless belt, a rotary brush roller which is opposed to the material to be electrified via the endless belt and depresses the endless belt onto the material to be electrified, and a power source which applies an electrification voltage to the endless belt.

2. An apparatus for electrifying a material to be electrified by physically contacting an electrifying member with the material to be electrified, the electrifying member comprises a flexible, hollow and electrically conducting roller capable of rotation, a brush roller which is provided inside and concentric to the electrically conducting roller and has a center of rotation in common with the electrically conducting roller and is capable of rotation relative to the rotation to the electrically conducting roller, and a power source which applies an electrification voltage to the electrically conducting roller.

3. An apparatus for electrifying a material to be electrified by bringing an electrifying member impressed with a voltage into physical contact with the material to be electrified, said apparatus comprising an electrifying member which comprises a flexible electrically conducting endless belt, a rotary brush roller which is disposed in pressing relationship to the endless belt and presses the endless belt into contact with the material to be electrified, a means to apply an electrification voltage to the endless belt, said material to be electrified being capable of movement, said endless belt being capable of movement at a speed in synchronism with the material to be electrified, and said brush roller being capable of movement at a speed different from the endless belt.

4. An apparatus for electrifying a material to be electrified by bringing an electrifying member impressed with a voltage into physical contact with the material to be electrified, said apparatus comprising an electrifying member which comprises a flexible, hollow electrically conducting roller capable of rotation, a brush roller which is provided inside and concentric to said hollow electrically conducting roller and capable of rotation relative to said roller a power source which applies an electrification voltage to said hollow electrically conducting roller, said material to be electrified being capable of movement, said hollow electrically conducting roller being capable of moving at a speed in synchronism with the material to be electrified, and said brush roller being capable of movement at speed different from that of the hollow electrically conducting roller.

5. A method for electrifying a material to be electrified by physically contacting an electrifying member with the material to be electrified, the electrifying member comprising a flexible and electrically conducting endless sheet and a brush which imparts a pressing force to the endless sheet to press the endless sheet against the material to be electrified, which method comprises applying an electrification voltage to the endless sheet, contacting the endless sheet with the material to be electrified, applying a pressing force with the brush to press the endless sheet against the material to be electrified, moving the material to be electrified, moving the endless sheet at a speed which is substantially in synchronism with the material to be electrified, and driving the brush at a different speed from the speed of the endless sheet.

6. An electrifying method according to claim 5, wherein the flexible and electrically conducting endless sheet is a seamless tube.

7. An electrifying method according to claim 5, wherein the flexible and electrically conducting endless sheet is a seamless and endless belt.

8. An electrifying method according to claim 5, wherein the brush is a rotary brush roller.

9. An electrifying method according to claim 5, wherein the brush is made of an electrically conducting organic or inorganic fiber.

10. An electrifying method according to claim 5, wherein the brush is made of an electrically nonconducting organic or inorganic fiber.

11. An electrifying method according to claim 5, wherein the brush is driven in the same direction as the direction in which the endless sheet moves and at a speed 1.1 to 5 times as great as the speed at which the endless sheet moves.

12. An electrifying method according to claim 5, wherein the brush is driven in a direction opposite to the direction in which the endless sheet moves and at a speed 1.1 to 3 times as great as the speed at which the endless sheet moves.

13. An electrifying method according to claim 5, wherein the electrification voltage applied to the endless sheet is a DC voltage which is 1.5 to 3.5 times as great as the electrification start voltage for the material that is to be electrified.

14. An electrifying method according to claim 5, wherein the electrification voltage applied to the endless sheet is obtained by superposing an AC voltage on a DC voltage that is 1.5 to 2 times as great as the electrification start voltage for the material that is to be electrified.

* * * * *